US006901936B2

(12) United States Patent
Kampel

(10) Patent No.: US 6,901,936 B2
(45) Date of Patent: Jun. 7, 2005

(54) HAIR-STYLING DEVICE HAVING ION-EMITTING CERAMIC MATERIAL COMPONENTS

(75) Inventor: Michelle Kampel, Fairfield, CT (US)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 10/893,440

(22) Filed: Jul. 16, 2004

(65) Prior Publication Data

US 2005/0011534 A1 Jan. 20, 2005

Related U.S. Application Data

(60) Provisional application No. 60/488,516, filed on Jul. 18, 2003.

(51) Int. Cl.[7] ..... A45D 2/14; A45D 2/00

(52) U.S. Cl. ..... 132/262; 132/245

(58) Field of Search ..... 132/262, 163, 132/245, 222, 260; 219/222

(56) References Cited

U.S. PATENT DOCUMENTS

| | | | | |
|---|---|---|---|---|
| 3,474,796 A | * | 10/1969 | Fineman | 132/226 |
| 4,699,159 A | * | 10/1987 | Thaler | 132/226 |
| 4,740,669 A | * | 4/1988 | Takimae | 219/225 |
| 5,573,016 A | * | 11/1996 | Graves | 132/254 |

* cited by examiner

*Primary Examiner*—John J. Wilson
*Assistant Examiner*—Robyn Doan
(74) *Attorney, Agent, or Firm*—Lawrence Cruz; Steven A. Garner

(57) ABSTRACT

A ceramic-containing sleeve or a ceramic-based coating on the surface of a roller or curler. The coating or sleeve comprises a mixture of components including, substantially, silicon oxide. While the present invention rollers emit ions without application of heat, heat may be applied to a roller via a conventional blow dryer or other hair dryer to achieve other results and to enhance ion emission. The ceramic materials also provide enhanced performance in terms of heat transfer, retention and distribution.

12 Claims, 2 Drawing Sheets

HAIR-STYLING DEVICE HAVING ION-EMITTING CERAMIC MATERIAL COMPONENTS

CROSS-REFERENCE TO RELATED APPLICATIONS

This application claims priority to U.S. Provisional Patent Application Ser. No. 60/488,516 filed on Jul. 18, 2003, incorporated herein by reference in its entirety.

BACKGROUND OF THE INVENTION

1. Field of the Invention

The present invention relates to devices for styling hair such as rollers or curlers and, more particularly, to such devices that are provided with ceramic material components that emit ions in concentrations that enhance or improve hair characteristics.

2. Description of Related Art

It is known in the art that delivering ions or ionically charged molecules to a person's hair provides benefits including the removal of undesirable static charge that naturally occurs in hair. Furthermore, it is believed that ions purify by removing particles present in the environment. Various hair care and hair styling implements exist such as hair dryers and heated brushes that comprise an ion generator that emits ions in response to electrical energy or heat. For example, known hair dryers and heat brushes contain a metallic node system that delivers ions into the stream of flowing air within the dryer when voltage is applied to the node. Other examples include hair driers that have a ceramic radiator positioned adjacent to a heater such that heat applied to the ceramic causes ions to emit and heat radiates from the ceramic.

The use of ceramic coatings in flat irons for straightening hair, as well as curling irons and other devices that contact the hair, is commonly known to provide desirable heat distribution, heat retention, and heat transfer characteristics that evenly, efficiently and predictably deliver heat to hair in comparison to non-coated metals.

Such known devices are suitable for but limited to hair styling techniques that require blow drying or brushing. No known device exists which enables the known benefits of ion delivery to be implemented with rollers or curlers. In order to achieve such an effect, it would be necessary to set one's hair with rollers and then utilize an ion-emitting blow dryer. This would require one to purchase a special ion-emitting blow dryer rather than to use a long-existing ordinary blow dryer.

It is desirable, therefore, to provide a roller or curler that has ion-emitting characteristics so that it could be used with any conventional hair dryer, either blow-dryer or bonnet dryer. It is also desirable to provide a roller or curler with a ceramic-coating or containing ceramic particles in order to produce superior characteristics of heat transfer, distribution and retention.

These and other objects are achieved by the present invention described herein.

BRIEF SUMMARY OF THE INVENTION

The present invention achieves the above-mentioned objects by utilizing either a ceramic-containing fabric around a roller or curler body or by providing a ceramic-based coating on the surface of a roller or curler. As in ordinary use, heat is applied to a roller via a conventional blow dryer or other hair dryer. While the present invention emits ions when no heat is applied, the application of heat from the dryer may be used to further activate the ceramic materials in the coating or fabric in order to emit ions or increase the emission of ions. The ceramic materials also provide enhanced performance in terms of heat transfer, retention and distribution.

DESCRIPTION OF THE PREFERRED EMBODIMENT

Figure 1A:
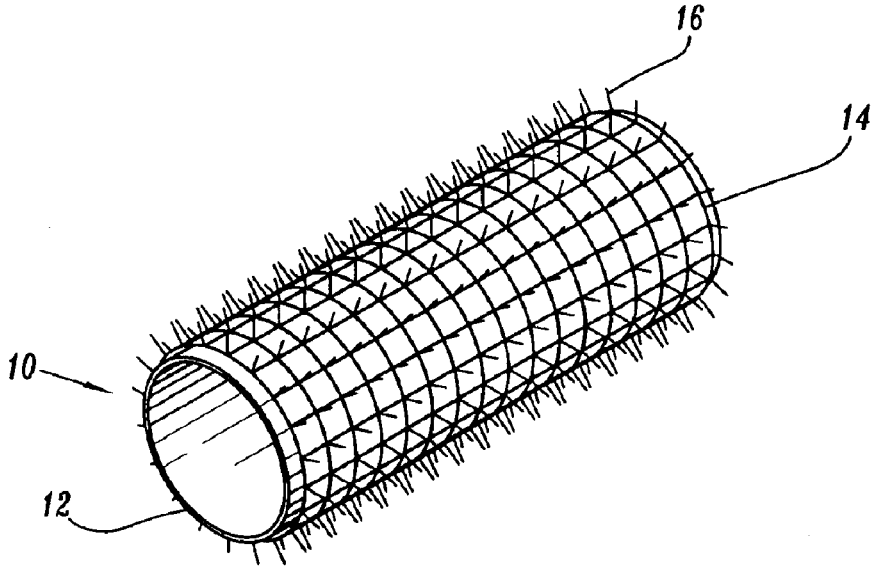
FIG. 1A is a perspective view of a roller according to a first embodiment of the present invention.
Figure 1B:
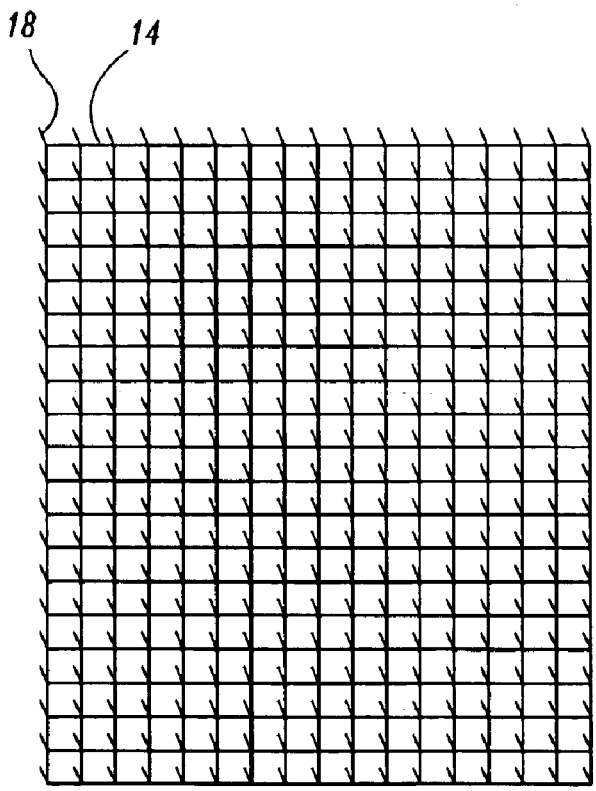
FIG. 1B is a perspective view of a mesh sleeve according to a first embodiment of the present invention.

A ceramic roller (10) according to a first embodiment of the present invention is shown in FIG. 1A. The roller (10) comprises a rigid body (12) in the shape of a hollow cylinder. A sleeve (14) in the form of a mesh fabric having bristles (16) extending therefrom is positioned around the roller body (12) so that the bristles (16) extend radially outwardly from the roller (10) as shown. Referring to FIG. 1B, the mesh sleeve (14), shown in an un-rolled position, comprises a series of fibers (18).

Each fiber is extruded from of a novel ionic powder mixed with nylon. The ionic powder is ceramic-based and comprises the following materials, by approximate composition as indicated in the following TABLE I:

TABLE I

| Composition | Percent of composition (%) |
|---|---|
| Silicon oxide | 99.530 |
| aluminum oxide | 0.1470 |
| Ferrous oxide | 0.0320 |
| Natrium oxide | 0.0100 |
| potassium oxide | 0.0230 |
| Titanium oxide | 0.0250 |
| Calcium oxide | 0.0270 |
| magnesium oxide | 0.0070 |
| Water | 0.1990 |

After the fibers (18) are woven into a fabric, the fabric is rolled about and fixed to the roller body (12) to form a sleeve (14). The sleeve (14) may be fixed to the body (12) by adhesive or heat sealing. In a preferred form of the present invention, the fabric emits negative ions in an amount around 200 per cubic centimeter. As tested, the fabric emits ions even when no heat is applied, though applying heat enhances the emission of ions. The output can vary by varying the percentage of the ionic powder in ratio to the nylon fiber material.

Thus, in use, a user wraps the rollers (10) into one's hair and lets the roller (10) sit for a period of time to apply ions and/or to shape the hair. Application of heat from a dryer enhances the effect of both ion generation and hair shaping.

Figure 2:
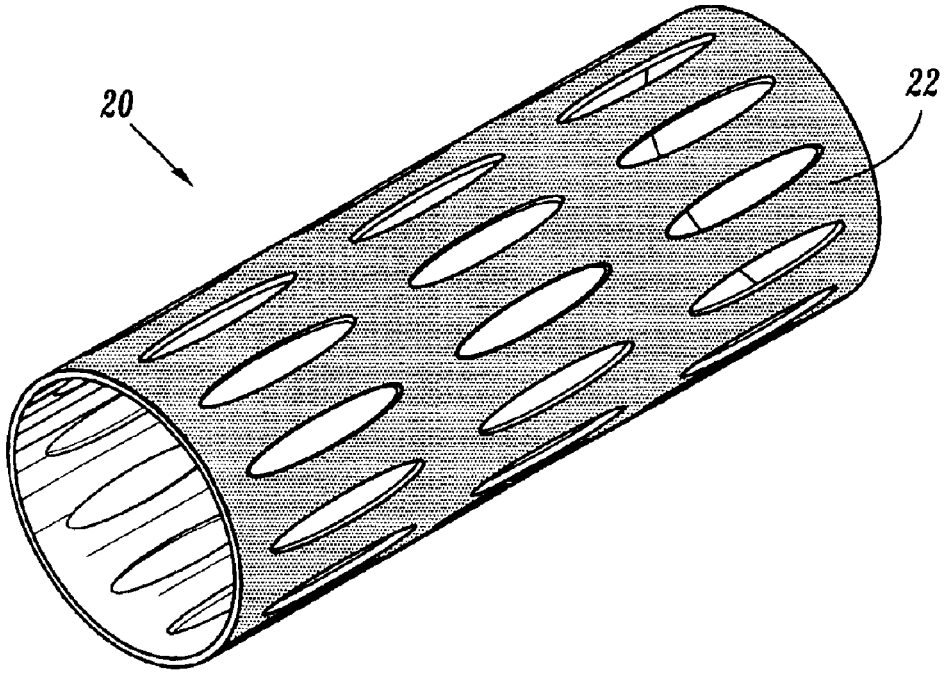
FIG. 2 is a perspective view of a roller according to a second embodiment of the present invention.

A second embodiment of the present invention is shown in FIG. 2. Referring to FIG. 2, a roller comprises a unitary body (20) to which a novel coating is applied to the outer surface (22). The coating can be applied as a paint or spray on, and may have other additives for coloring. The novelty of the coating is in its implementation of the ionic substance mix illustrated in TABLE I, which is mixed together with a liquid base that is designed to dry after spraying or dipping of the roller body (20). The liquid base may be a paint or hardshell coating of the type known in the art. The amount of ion output can vary depending on the percentage of the ion mixture of TABLE I in ratio to the liquid base.

While the preferred present invention has been herein described, it is understood that various modification may be made without departing from the scope of the present invention.

What is claimed is:

1. A hair roller comprising:

a body; and a sleeve around said body, said sleeve formed from fibers comprising a combination of nylon and a composition of between 95.0 and 99.9% silicon oxide, 0.05 and 0.40% aluminum oxide, 0.01 and 0.08% ferrous oxide, 0.005 and 0.030% natrium oxide, 0.01 and 0.05% potassium oxide, 0.01 and 0.05% titanium oxide, 0.01 and 0.05% calcium oxide, 0.001 and 0.050% magnesium oxide, and 0.01 and 0.50% water.

2. A hair roller according to claim 1, wherein said body is hollow.

3. A hair roller according to claim 1, wherein said body is substantially cylindrical.

4. A hair roller according to claim 1, wherein said body is rigid.

5. A hair roller according to claim 1, wherein said sleeve is a mesh fabric woven from said fibers.

6. A hair roller according to claim 5, wherein said sleeve has bristles extending radially outwardly from said body.

7. A hair roller according to claim 1, wherein said sleeve is fixed to said body by adhesive.

8. A hair roller according to claim 1, wherein said sleeve is fixed to said body by heat sealing.

9. A hair roller comprising:

a body; and a coating on said body, said coating comprising a combination of a liquid base and a composition of between 95.0 and 99.9% silicon oxide, 0.05 and 0.40% aluminum oxide, 0.01 and 0.08% ferrous oxide, 0.005 and 0.030% natrium oxide, 0.01 and 0.05% potassium oxide, 0.01 and 0.05% titanium oxide, 0.01 and 0.05% calcium oxide, 0.001 and 0.050% magnesium oxide, and 0.01 and 0.50% water.

10. A hair roller according to claim 9, wherein said liquid base is a paint or hardshell coating.

11. A hair roller according to claim 9, wherein said body is hollow.

12. A hair roller according to claim 9, wherein said body is substantially cylindrical.

* * * * *